US011550244B1

(12) United States Patent
Kuge et al.

(10) Patent No.: US 11,550,244 B1
(45) Date of Patent: Jan. 10, 2023

(54) RECORDING-MEDIUM TRANSPORT DEVICE, FIXING DEVICE, AND IMAGE FORMING APPARATUS

(71) Applicant: FUJIFILM Business Innovation Corp., Tokyo (JP)

(72) Inventors: Hideki Kuge, Kanagawa (JP); Takayuki Ukawa, Kanagawa (JP); Kei Tanaka, Kanagawa (JP); Masataka Momma, Kanagawa (JP); Norio Ogawahara, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/543,067

(22) Filed: Dec. 6, 2021

(30) Foreign Application Priority Data

Aug. 25, 2021 (JP) ..... JP2021-137637

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

U.S. PATENT DOCUMENTS

2010/0272480 A1* 10/2010 Kamijo ..... G03G 15/1675 399/314

FOREIGN PATENT DOCUMENTS

JP 2006-259223 A 9/2006

* cited by examiner

*Primary Examiner* — Victor Verbitsky
(74) *Attorney, Agent, or Firm* — Oliff PLC

(57) ABSTRACT

A recording-medium transport device includes: a rotating first and second member, the first and second member forming a nip area therebetween and transporting a recording medium while nipping; a gripping member that grips the recording medium; a separating member that separates the recording medium passing through the nip area from the first or second member; and a control mechanism that controls contact and separation between the first and second member and opening and closing the gripping member where, in a first section, the gripping member passes between the first and second member, the first and second member are separated, and the gripping member is opened to release the recording medium until the first and second member come into contact with each other and, in a second section subsequent to the first section and before the recording medium reaches the separating member, the gripping member opens wider than the first section.

18 Claims, 16 Drawing Sheets

RECORDING-MEDIUM TRANSPORT DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2021-137637 filed Aug. 25, 2021.

BACKGROUND

(i) Technical Field

The present disclosure relates to a recording-medium transport device, a fixing device, and an image forming apparatus.

(ii) Related Art

Japanese Unexamined Patent Application Publication No. 2006-259223 discloses a fixing device including: a fixing roller pair including a first fixing roller and a second fixing roller, at least one of which serves as a heating roller, and the surface layer of at least one of which can be replaced; a sticking part including a sticking member; a charging member that charges at least one of a recording medium and the sticking part; and a fixing member that physically fixes the leading end of the recording medium in the transport direction to the sticking part by a gripping part. The fixing devices fixes the image by electrostatically adhering the sticking member and the recording medium together by the charging member, fixing the recording medium to the sticking part by the fixing member, and then nipping and transporting the recording medium, together with the sticking part, by the fixing roller pair.

SUMMARY

Aspects of non-limiting embodiments of the present disclosure relate to providing a recording-medium transport device, a fixing device, and an image forming apparatus with which, when a recording medium is transported in a gripped state, it is possible to avoid formation of creases on the recording medium due to gripping of the recording medium and to prevent contact between members.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a recording-medium transport device including: a first member that rotates; a second member that rotates, the first member and the second member forming a nip area therebetween and transporting a recording medium while nipping; a gripping member that grips the recording medium; a separating member that separates the recording medium having passed through the nip area from the first member or the second member; and a control mechanism that controls contact and separation between the first member and the second member and opening and closing of the gripping member such that, in a first section in which the gripping member passes between the first member and the second member, the first member and the second member are separated, and the gripping member is opened so as to release the recording medium until the first member and the second member are brought into contact with each other next time, and, in a second section subsequent to the first section and before the recording medium reaches the separating member, the gripping member is opened wider than in the first section.

BRIEF DESCRIPTION OF THE DRAWINGS

Exemplary embodiment of the present disclosure will be described in detail based on the following figures, wherein.

DETAILED DESCRIPTION

Figure 1:
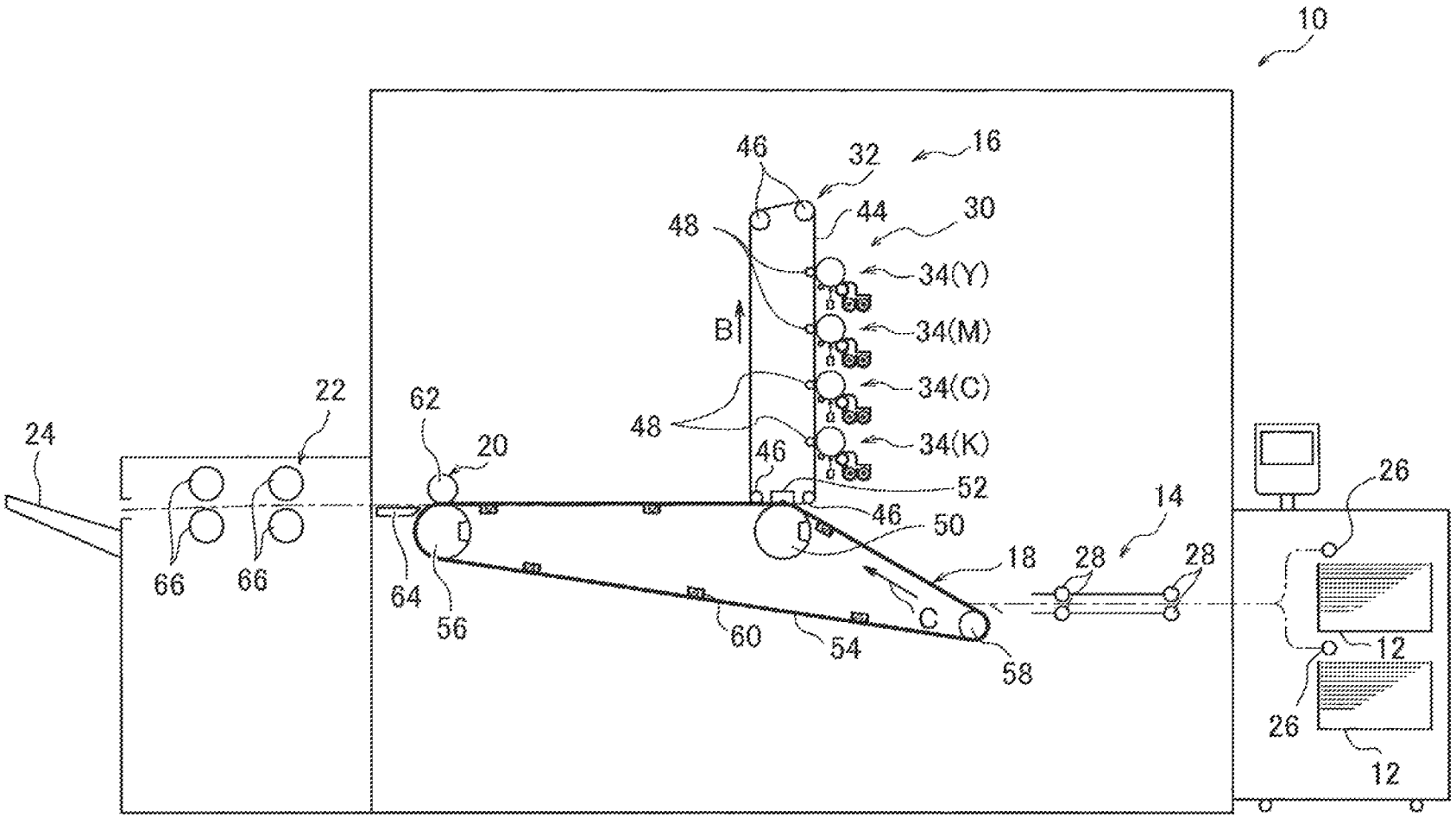
FIG. 1 is a front view of an image forming apparatus according to an exemplary embodiment of the present disclosure.

FIG. 1 shows an image forming apparatus 10 according to an exemplary embodiment.

The image forming apparatus 10 includes recording-medium storage portions 12, a recording-medium transport unit 14, an image forming unit 16, a recording-medium transport device 18, a fixing device 20, a cooling unit 22, and a recording-medium discharge portion 24.

The image forming apparatus 10 includes, for example, two recording-medium storage portions 12 each accommodating recording media. The recording-medium transport unit 14 includes feed-out members 26 that are provided above the recording-medium storage portions 12 and that feed out the recording media from the recording-medium storage portions 12. The recording media fed out by the feed-out members 26 are transported to the recording-medium transport device 18 by transport members 28.

The image forming unit 16 includes a developer-image forming unit 30 and an intermediate transfer unit 32.

The developer-image forming unit 30 includes multiple image forming units 34 that form color toner layers. In this exemplary embodiment, the developer-image forming unit 30 includes four image forming units 34 corresponding to the respective colors, namely, a yellow image forming unit 34Y, a magenta image forming unit 34M, a cyan image forming unit 34C, and a black image forming unit 34K.

Yellow (Y), magenta (M), cyan (C), and black (K) are the base colors used to output a color image. In the description below, when there is no need to distinguish between the colors of the image forming units 34, the image forming units 34 will be simply called the "image forming units 34" without the letters Y, M, C, or K representing the respective colors.

Figure 2:
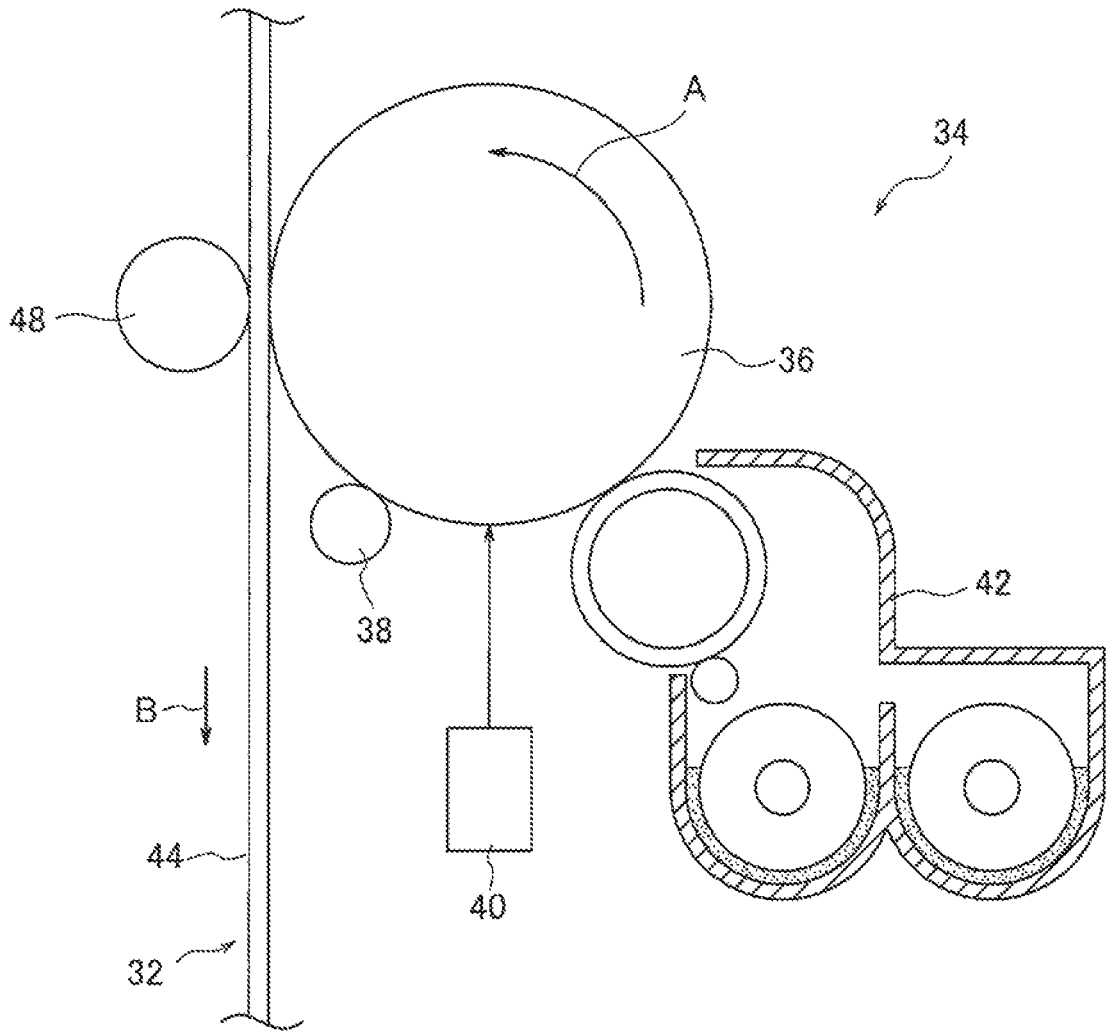
FIG. 2 is a front view of an image forming unit used in the image forming apparatus according to the exemplary embodiment of the present disclosure.

The image forming units 34 have basically the same configuration, except for the type of toner used. As shown in FIG. 2, each image forming unit 34 includes a cylindrical photoconductor 36, which rotates in the direction of arrow A, and a charger 38 that charges the photoconductor 36. The image forming unit 34 further includes an exposure device 40 that radiates exposure light onto the charged photoconductor 36 to form an electrostatic latent image, and a developing device 42 that develops the electrostatic latent image with developer containing toner into an image formed of a toner layer.

The photoconductors 36 corresponding to the respective colors are configured to be able to come into contact with the outer circumferential surface of an endless intermediate transfer belt 44 (described below). The image forming units 34 corresponding to yellow, magenta, cyan, and black are arranged in this order from the upstream side to the downstream side in the revolving direction of the intermediate transfer belt 44.

Although an example configuration in which an image is recorded with four color toners (C, M, Y, and K) will be described in this exemplary embodiment, the configuration is not limited thereto, and the colors of the toners and the combinations thereof may be changed. For example, toners of light colors, such as light cyan and light magenta, toners of deep colors, and toners of special colors may be added as necessary. Furthermore, the order of arrangement of the image forming units 34 corresponding to the respective colors is not limited to the order illustrated.

The intermediate transfer unit 32 includes the intermediate transfer belt 44 that revolves in the direction of allow B. The intermediate transfer belt 44 is stretched around multiple support rollers 46 and first transfer rollers 48, which are opposed to the image forming units 34 corresponding to the respective colors, so as to be held in an orientation. One of the multiple support rollers 46 has a function of rotating the intermediate transfer belt 44 in the direction of allow B with the power of a motor (not shown). The intermediate transfer belt 44 revolves in the direction of allow B to transport first-transferred images to a second transfer position.

The first transfer rollers 48 receive voltages from a power supply unit (not shown). These voltages serve as first transfer voltages for first-transferring the developer images formed on the photoconductors 36 to the intermediate transfer belt 44 between the photoconductors 36 and the first transfer rollers 48.

A second transfer portion 52, which includes a corotron, is provided opposite the transfer drum 50 with the intermediate transfer belt 44 therebetween. The developer image formed on the intermediate transfer belt 44 is transferred to a recording medium by the second transfer portion 52.

Figure 4:
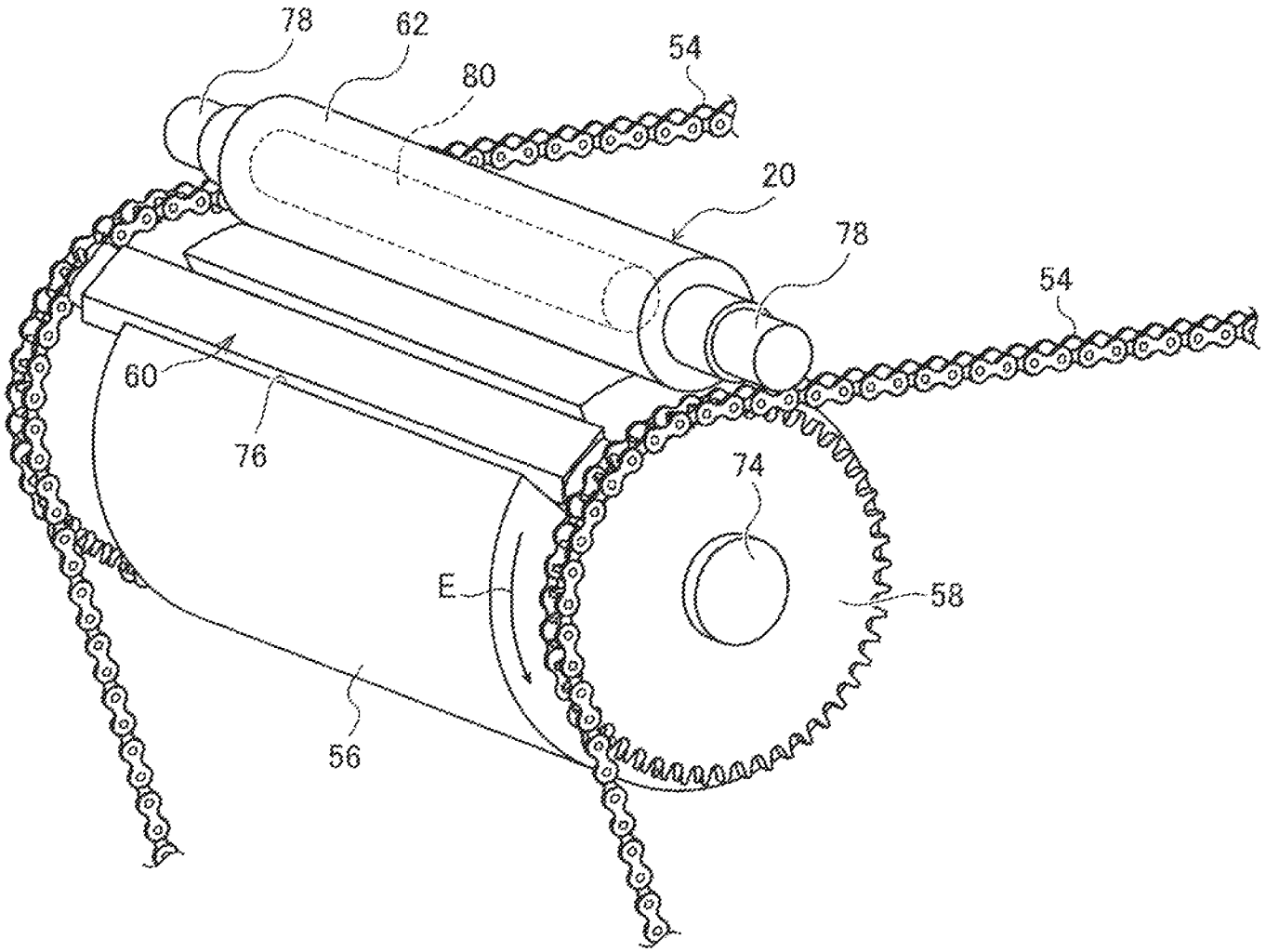
FIG. 4 is a perspective view showing a fixing device and the structure therearound in the image forming apparatus according to the exemplary embodiment of the present disclosure.

In this exemplary embodiment, the recording-medium transport device 18 includes chains 54, serving as transport members. The chains 54 are provided in pairs in the front-rear direction of the device and are stretched over sprockets provided on both sides of the transfer drum 50 and the fixing drum 56 in the axial direction (FIG. 4 shows sprockets 58 provided on the fixing drum 56) and the sprocket 58 provided near the recording-medium transport unit 14. The chains 54 are driven in the direction of arrow C as a result of any of these sprockets rotating.

The chains 54 are provided with multiple grippers 60, serving as gripping members. The grippers 60 grip the leading ends of recording media and, in this state, transport the recording media as the chains 54 move. The leading end of a recording medium transported from the recording-medium transport unit 14 is gripped by a gripper 60, and a developer image formed in the image forming unit 16 is transferred to the recording medium at the second transfer position and is then fixed thereto as the recording medium passes through the fixing device 20.

The fixing device 20 includes a heating member 62, which serves as a first member, and a fixing drum 56, which serves as a second member. The fixing device 20 nips a recording medium at a nip area formed between the heating member 62 and the fixing drum 56 and fixes the developer image to the recording medium with heat and pressure, while transporting the recording medium. The fixing device 20 has a separating member 64 on the exit side. The separating member 64 separates the recording medium from the fixing drum 56, and the separated recording medium is transported while being cooled by transport members 66 and 66 of the cooling unit 22 and is discharged on the recording-medium discharge portion 24.

When the heating member 62 is called the first member, and the fixing drum is called the second member, not only the heating member and the fixing drum themselves, but also the associated components, such as rotary shafts, are included.

Figure 3:
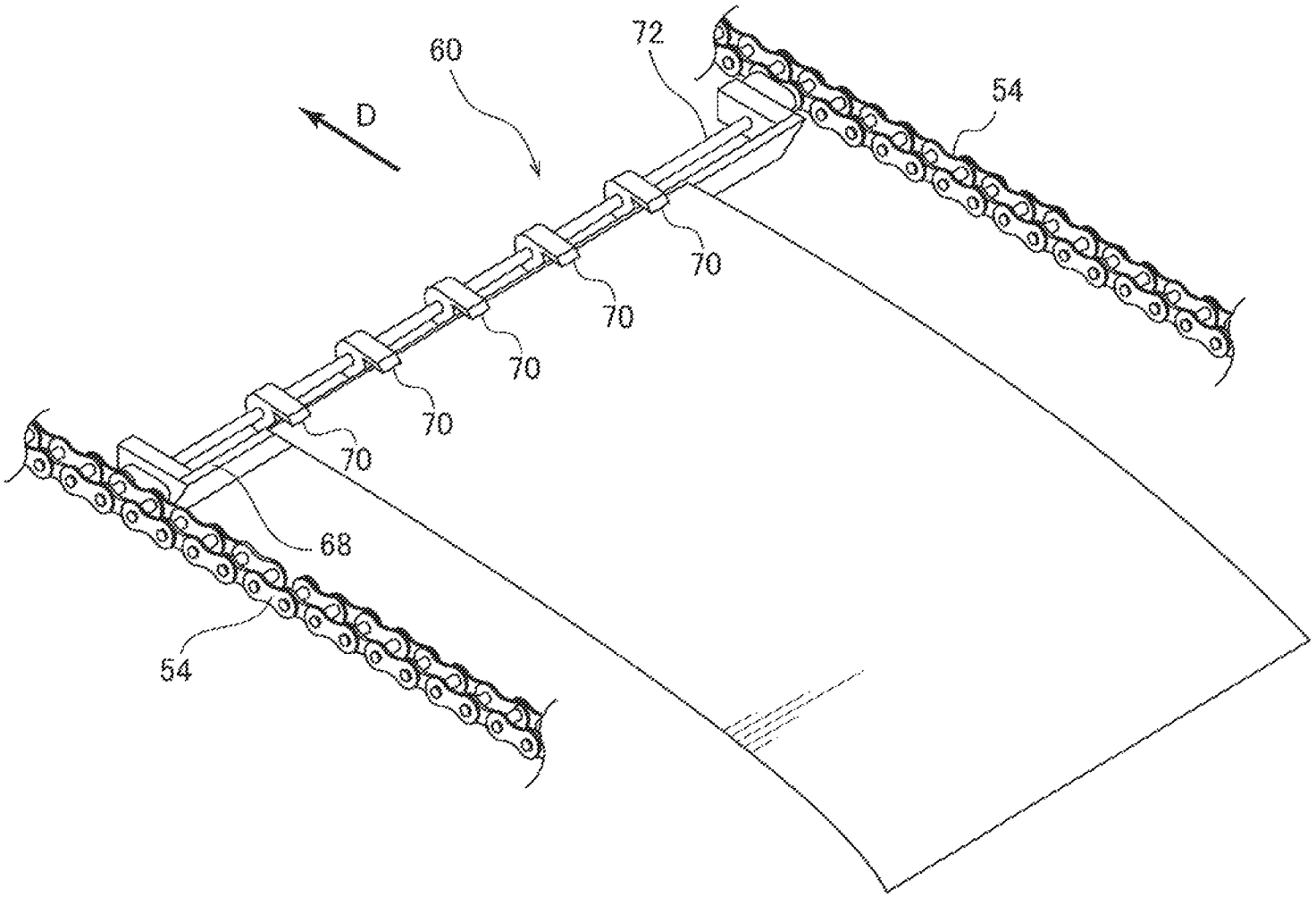
FIG. 3 is a perspective view showing a state in which a gripper grips a recording medium in the image forming apparatus according to the exemplary embodiment of the present disclosure.

As shown in FIG. 3, the gripper 60 includes a fixed jaw 68 and movable jaws 70 that move toward and away from the fixed jaw 68. The fixed jaw 68 is fixed to the chains 54 at the ends thereof. Multiple movable jaws 70 are provided in the depth direction of the image forming apparatus 10. The multiple movable jaws 70 are fixed to a movable-jaw driving shaft 72 and are driven via the movable-jaw driving shaft 72. The leading end of a recording medium is nipped between the fixed jaw 68 and the movable jaws 70, and in this state, the recording medium is transported in the direction of arrow D.

As shown in FIG. 4, a fixing-drum rotary shaft 74 is provided at the center of the fixing drum 56. The fixing drum 56 and the sprockets 58 rotate in the direction of arrow E about the fixing-drum rotary shaft 74. The fixing drum 56 has a recess 76 extending in the depth direction. The recess 76 accommodates a gripper 60. As the fixing drum 56 rotates in the direction of arrow E, the gripper 60 accommodated in the recess 76 passes between the heating member 62 and the fixing drum 56. A heating-member rotary shaft 78 is provided at the center of the heating member 62, and the heating member 62 rotates about the heating-member rotary shaft 78 in the direction opposite to the rotating direction of the fixing drum 56. The heating member 62 has, inside thereof, a heating source 80.

Figure 5:
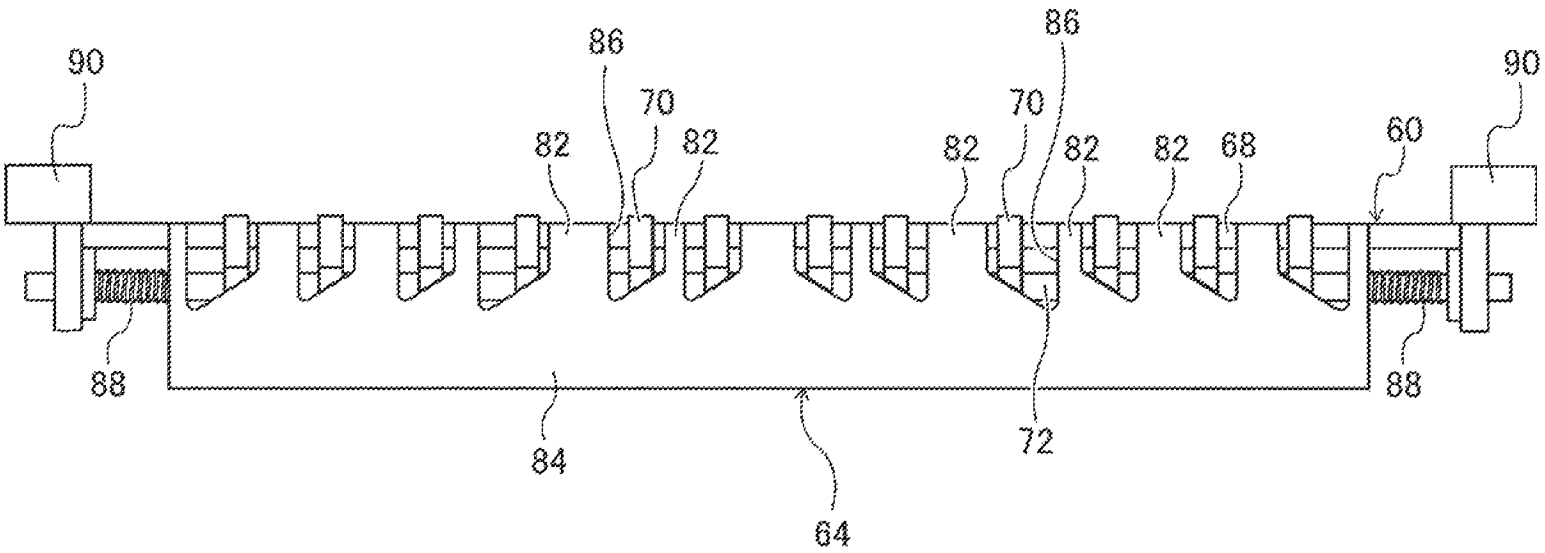
FIG. 5 is a plan view showing the gripper and a separating member in the image forming apparatus according to the exemplary embodiment of the present disclosure.

As shown in FIG. 5, in the separating member 64, separating parts 82 and a guide part 84, which is provided downstream of the separating parts 82 in the transport direction, are formed as a single component. Multiple separating parts 82 are formed toward the far side of the image forming apparatus 10. Grooves 86 are formed between adjoining separating parts 82. The movable jaws 70 of the gripper 60 are inserted into the grooves 86. Movable-jaw urging members 88 and 88 are wound on the both ends of the movable-jaw driving shaft 72. The movable-jaw urging members 88 and 88 urge the movable jaws 70 such that the movable jaws 70 are pressed against the fixed jaw 68. Furthermore, chain fixing parts 90 and 90 are provided at both ends of the fixed jaw 68, via which the fixed jaw 68 is fixed to the chains 54.

Figure 6:
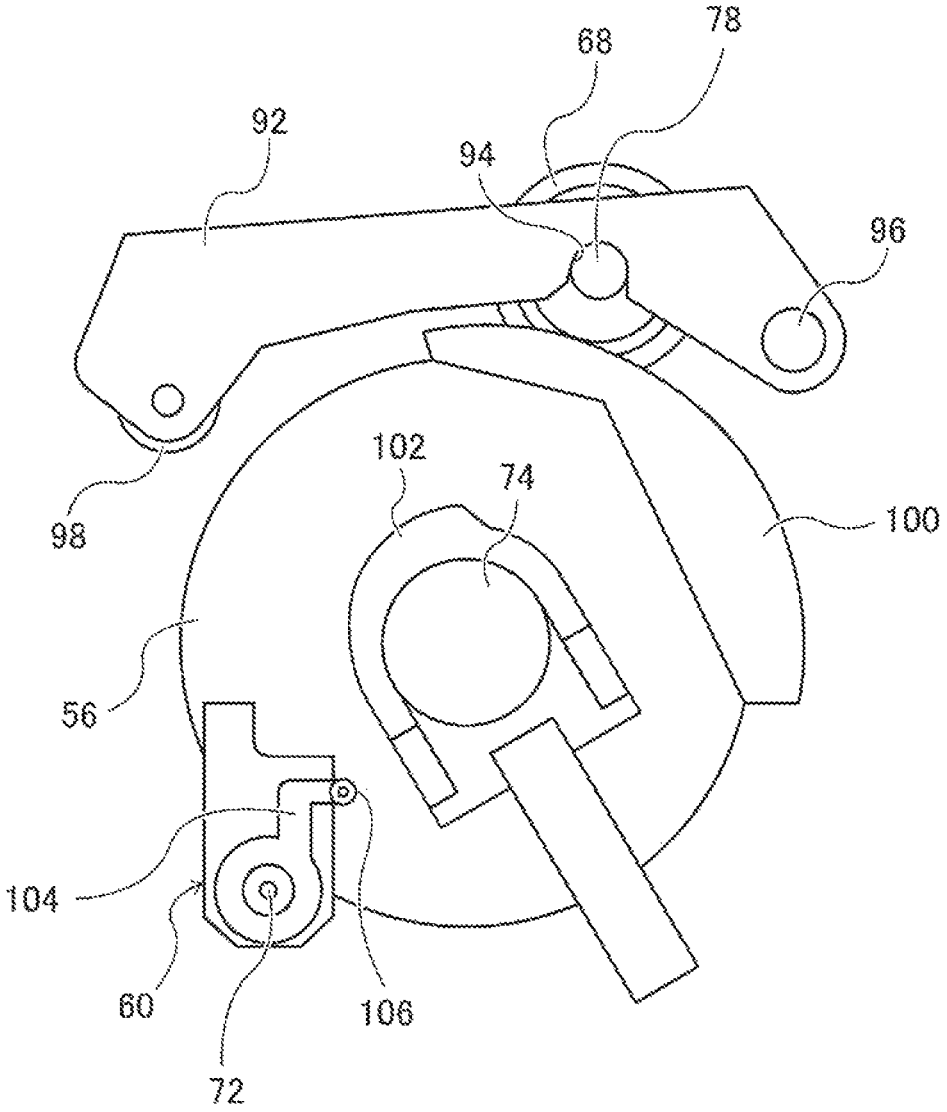
FIG. 6 is a front view of cam mechanisms that controls driving of a heating member and movable jaws in the image forming apparatus according to the exemplary embodiment of the present disclosure.

As shown in FIG. 6, the heating-member rotary shaft 78 is fitted in support grooves 94 provided in first arm members 92. The first arm members 92 are pivotably supported by first swing shafts 96 at first ends thereof. Heating-member cam followers 98 are provided at second ends of the first arm members 92.

The first arm members 92 have heating-member urging members (not shown) that press the heating member 62 against the fixing drum 56 such that the nip area is formed between the heating member 62 and the fixing drum 56.

A heating-member cam 100 is fixed to an outer circumferential portion of the fixing drum 56 and rotates with the fixing drum 56. The cam face of the heating-member cam 100 makes contact with the heating-member cam followers 98 within a predetermined angle. As a result of the heating-member cam followers 98 following the heating-member cam 100, the heating member 62 swings about the first swing shafts 96, thus controlling such that the heating member 62 comes into contact with and is separated from the fixing drum 56.

Movable-jaw cams 102 are provided around the fixing-drum rotary shaft 74. Although the movable-jaw cams 102 are provided coaxially with the fixing drum 56, the movable-jaw cams 102 do not follow the rotation of the fixing drum 56 and are fixed to the image forming apparatus body. Second arm members 104 are joined to the movable-jaw driving shaft 72 at first ends thereof and are provided with movable-jaw cam followers 106 at second ends thereof. The cam faces of the movable-jaw cams 102 make contact with the movable-jaw cam followers 106 within a predetermined angle. As a result of the movable-jaw cam followers 106 following the movable-jaw cams 102, the movable jaws 70 are controlled so as to come into contact with and be separated from the fixed jaw 68.

Figure 7:
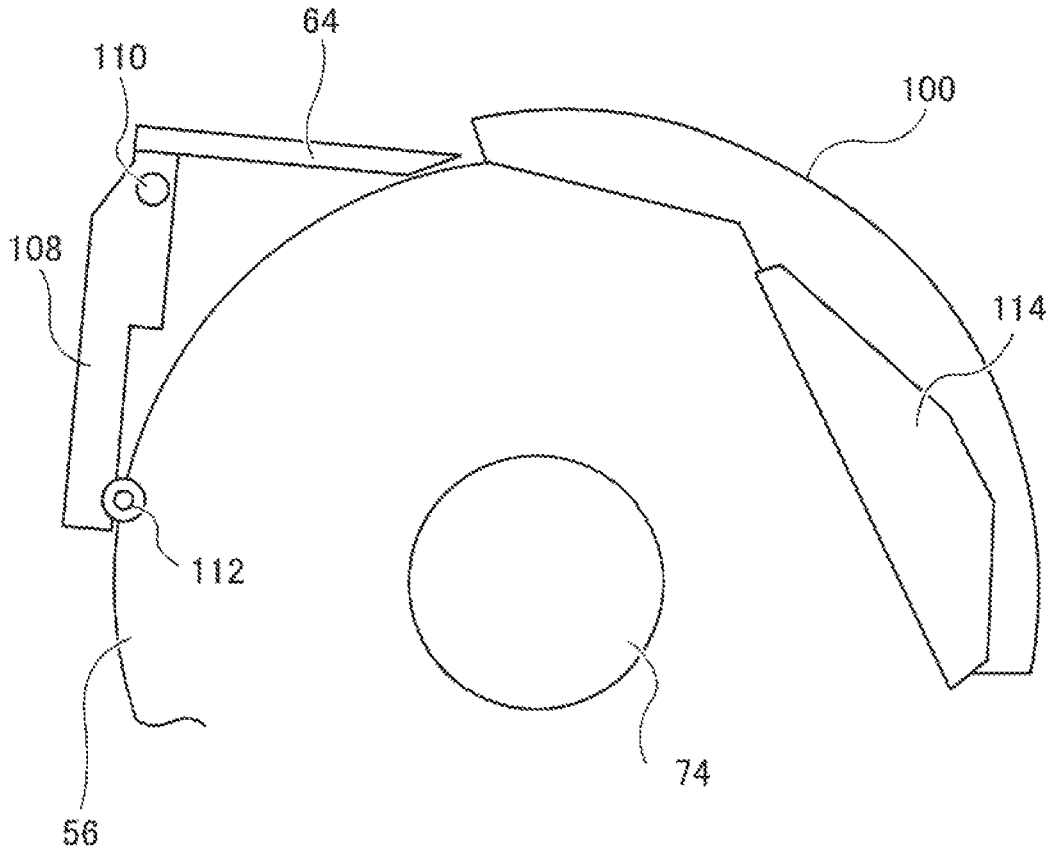
FIG. 7 is a front view of a cam mechanism that controls driving of the separating member in the image forming apparatus according to the exemplary embodiment of the present disclosure.

As shown in FIG. 7, the separating member 64 is fixed to first ends of third arm members 108. The third arm members 108 are pivotably supported by a second swing shaft 110 at first ends thereof and are provided with separating-member cam followers 112 at second ends thereof.

The third arm members 108 are provided with separating-member urging members (not shown) that urge the separating member 64 in a direction away from the fixing drum 56.

Separating-member cams 114 are fixed to an outer circumferential portion of the fixing drum 56, at sides of the heating-member cam 100, and rotate with the fixing drum 56. The cam faces of the separating-member cams 114 make contact with the separating-member cam followers 112 within a predetermined angle. As a result of the separating-member cam followers 112 following the separating-member cams 114, the third arm members 108 swing about the second swing shaft 110, thus controlling the movement of the separating member 64 such that the tip of the separating member 64 enters the recess 76 from a position away from the outer circumference of the fixing drum 56 and then moves from the recess 76 to a position away from the outer circumference of the fixing drum 56.

Figure 8:
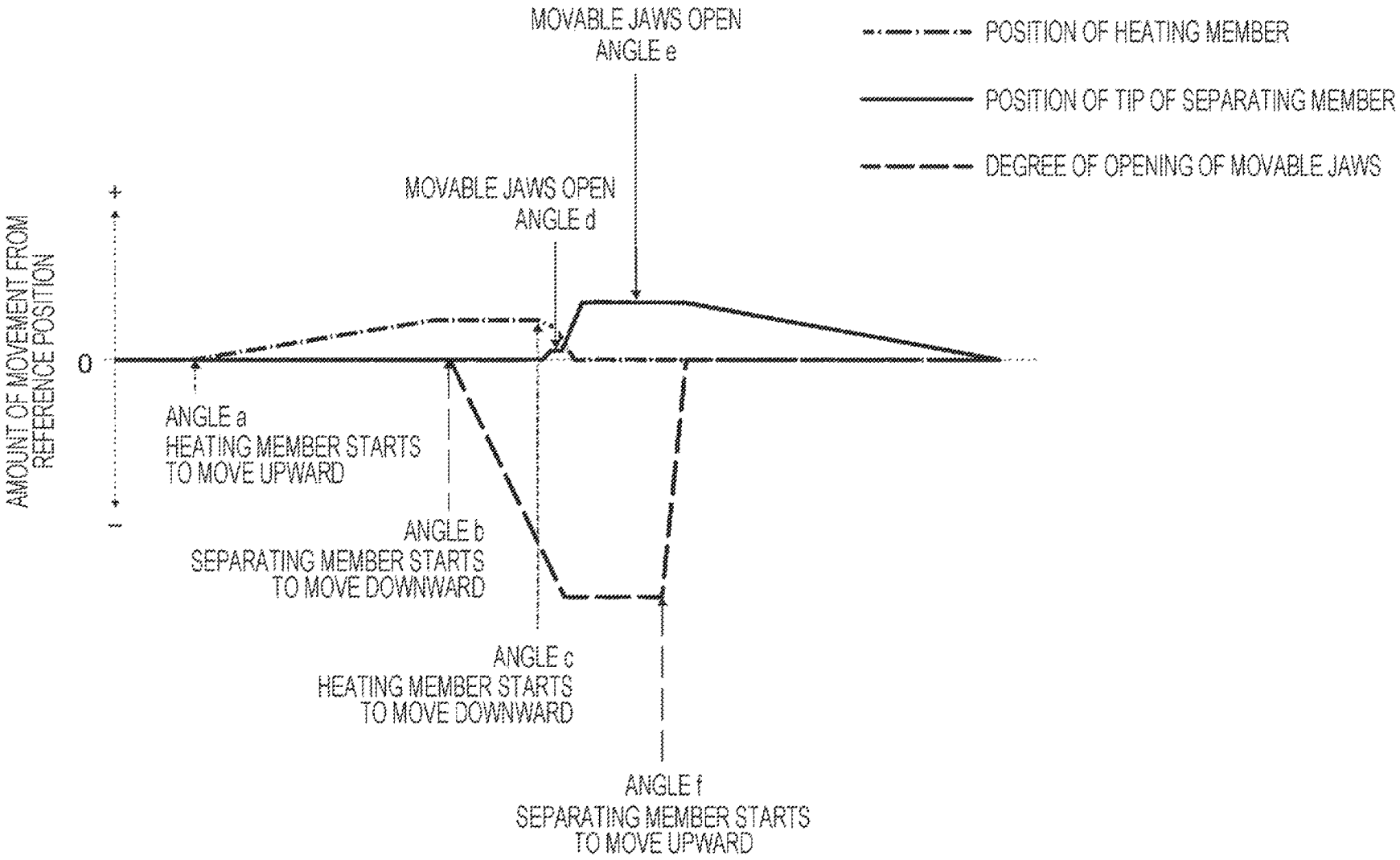
FIG. 8 is a timing chart showing the movements of the heating member, the separating member, and the movable jaws with respect to the rotation angle of the fixing drum in the image forming apparatus according to the exemplary embodiment of the present disclosure.

FIG. 8 is a timing chart showing movement control of the heating member 62, the separating member 64, and the movable jaws 70. The horizontal axis represents the rotation angle of the fixing drum 56, and the vertical axis represents the position of the heating member 62, the position of the tip of the separating member 64, and the degree of opening of the movable jaws 70. In the timing chart, O represents the reference position.

First, at angle a, as a result of the heating-member cam followers 98 following the cam face of the heating-member cam 100, the heating member 62 starts to move upward (i.e., move in a direction away from the fixing drum 56). Next, at angle b, as a result of the separating-member cam followers 112 following the separating-member cams 114, the separating member 64 starts to move downward (i.e., move in a direction in which the tip of the separating member 64 enters the recess 76).

Then, at angle c, the heating member 62 starts to move downward (i.e., move in a direction in which the heating member 62 comes into contact with the fixing drum 56). At angle d immediately after the heating member 62 starts to move downward, as a result of the movable-jaw cam followers 106 following the movable-jaw cams 102, the movable jaws 70 are opened (i.e., the movable jaws 70 move in a direction away from the fixed jaw 68).

Figure 9:
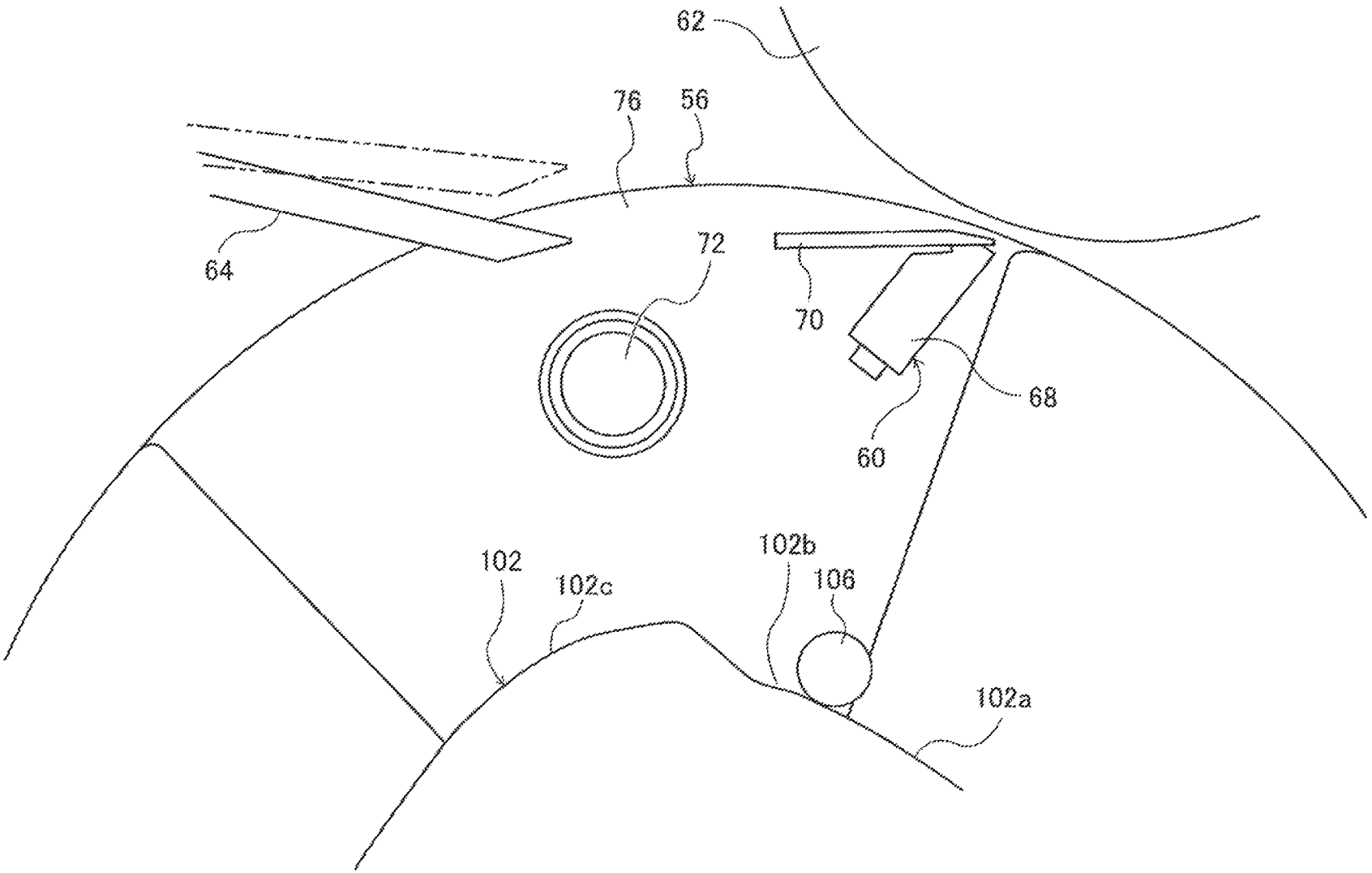
FIG. 9 is an enlarged front view of the fixing device showing a state in which the movable jaws start to open in the image forming apparatus according to the exemplary embodiment of the present disclosure.

FIG. 9 shows a state when the movable jaws 70 start to open. The heating member 62 is separated from the fixing drum 56. The separating member 64 moves from a position (indicated by a two-dot chain line) where the tip of the separating member 64 is located outside the outer circumference of the fixing drum 56 to a position (indicated by a solid line) where the tip of the separating member 64 is located inside the recess 76 in the fixing drum 56. The movable-jaw cam followers 106 start to climb from first faces 102*a* to second faces 102*b*, which are higher than the first faces 102*a*, formed on the movable-jaw cams 102. When the movable-jaw cam followers 106 start to climb the second faces 102*b* of the movable-jaw cams 102, the movable-jaw driving shaft 72 rotates counterclockwise, and the movable jaws 70 start to open. As a result, the leading end of the recording medium gripped between the movable jaws 70 and the fixed jaw 68 is released.

Figure 10:
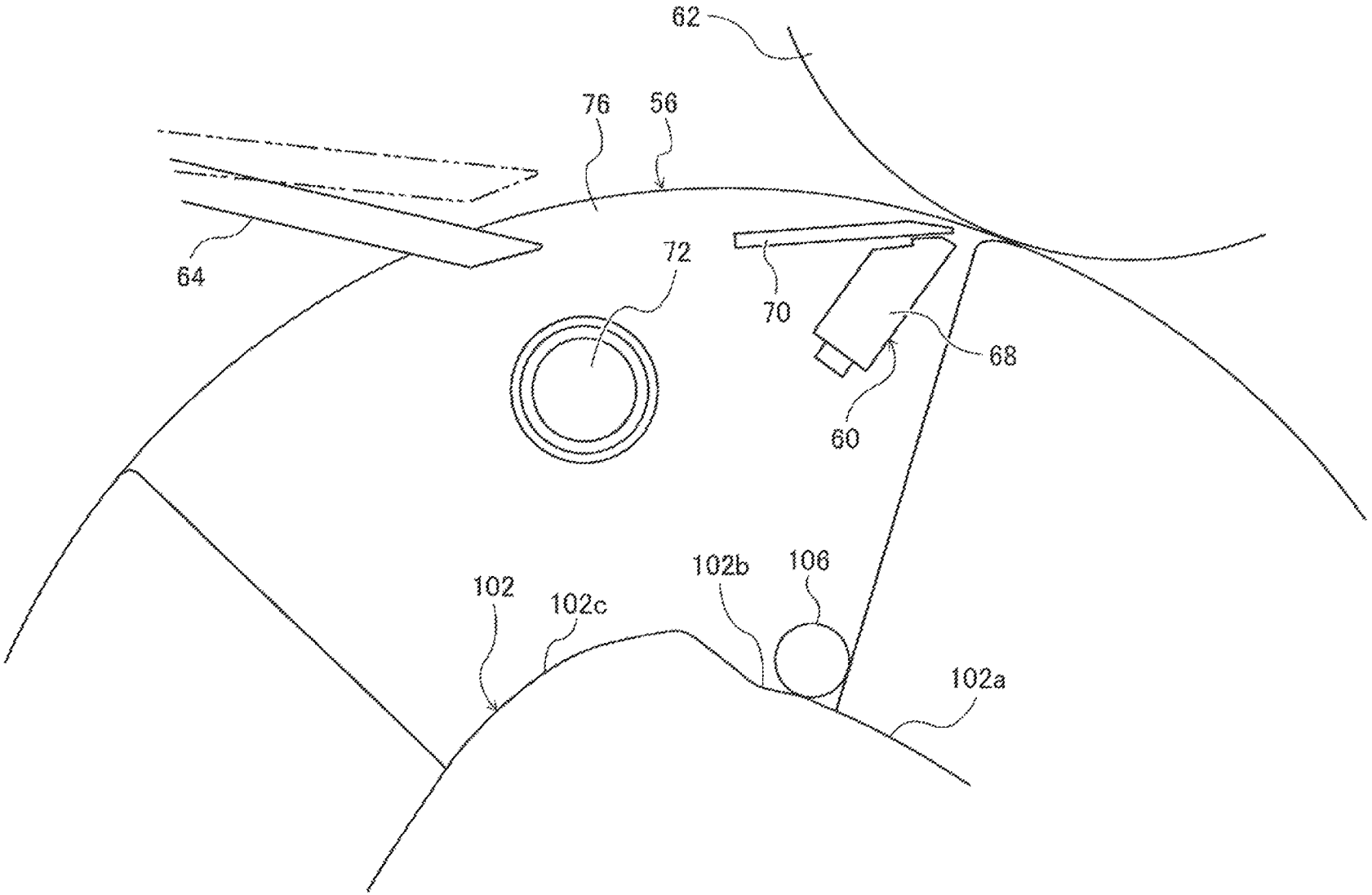
FIG. 10 is an enlarged front view of the fixing device showing a state in which the heating member is in contact with the fixing drum in the image forming apparatus according to the exemplary embodiment of the present disclosure.
Figure 11:
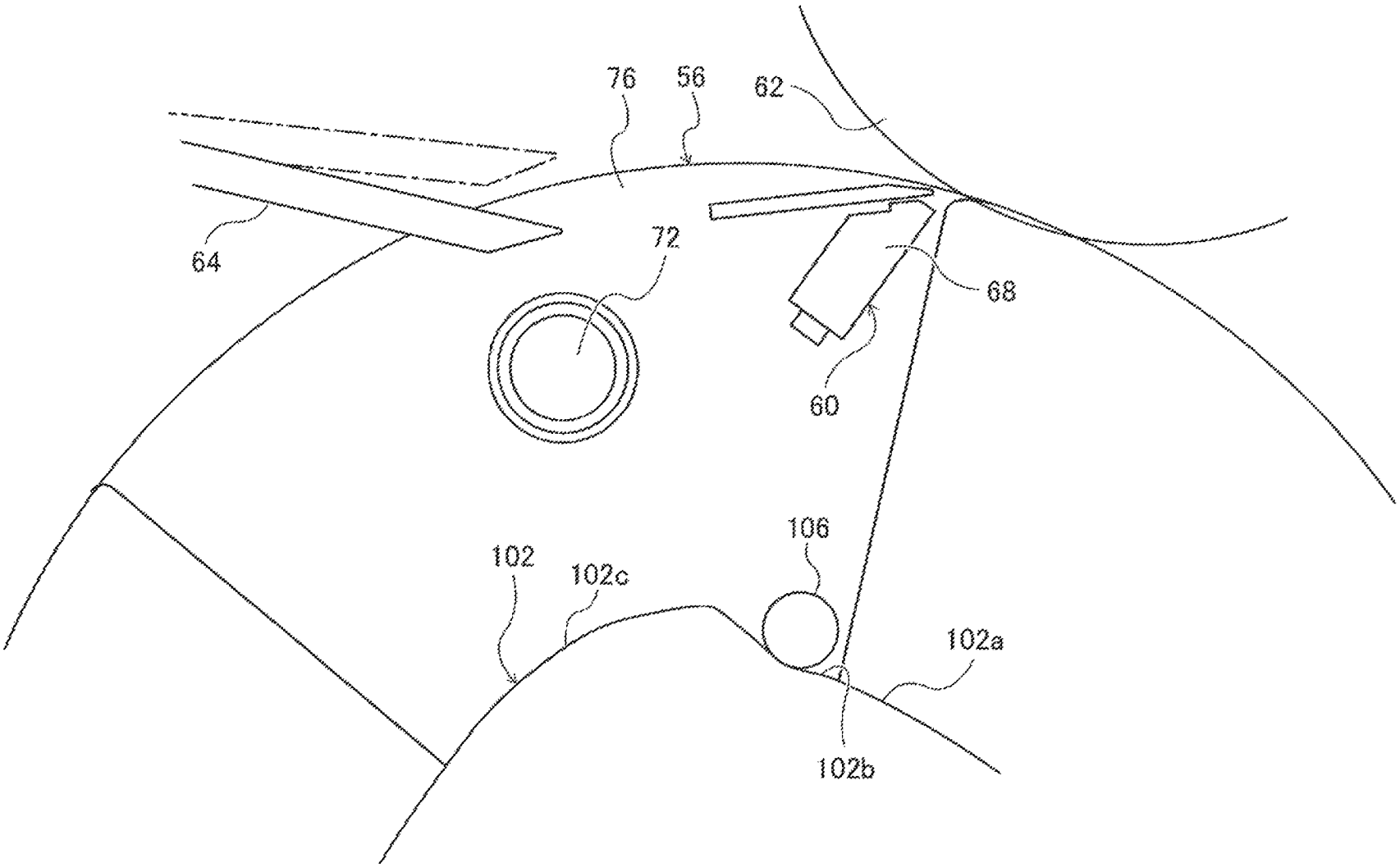
FIG. 11 is an enlarged front view of the fixing device showing a state in which a nip area is formed between the heating member and the fixing drum in the image forming apparatus according to the exemplary embodiment of the present disclosure.

Referring to FIG. 10, when the fixing drum 56 rotates further, the heating member 62 comes into contact with the fixing drum 56. When the fixing drum 56 rotates even further, as shown in FIG. 11, the heating member 62 is pushed by the fixing drum 56, and a nip area is formed therebetween. Once the nip area is formed between the heating member 62 and the fixing drum 56, the movable-jaw cam followers 106 start to climb from the second faces 102*b* to third faces 102*c*, which are higher than the second faces 102*b*, of the movable-jaw cams 102. Once the movable-jaw cam followers 106 start to climb the third faces 102*c* of the movable-jaw cams 102, the movable-jaw driving shaft 72 rotates counterclockwise, and the movable jaws 70 move so as to open even wider.

Referring back to FIG. 8, at angle e, the movable jaws 70 move so as to open even wider from the state thereof at angle d.

Figure 12:
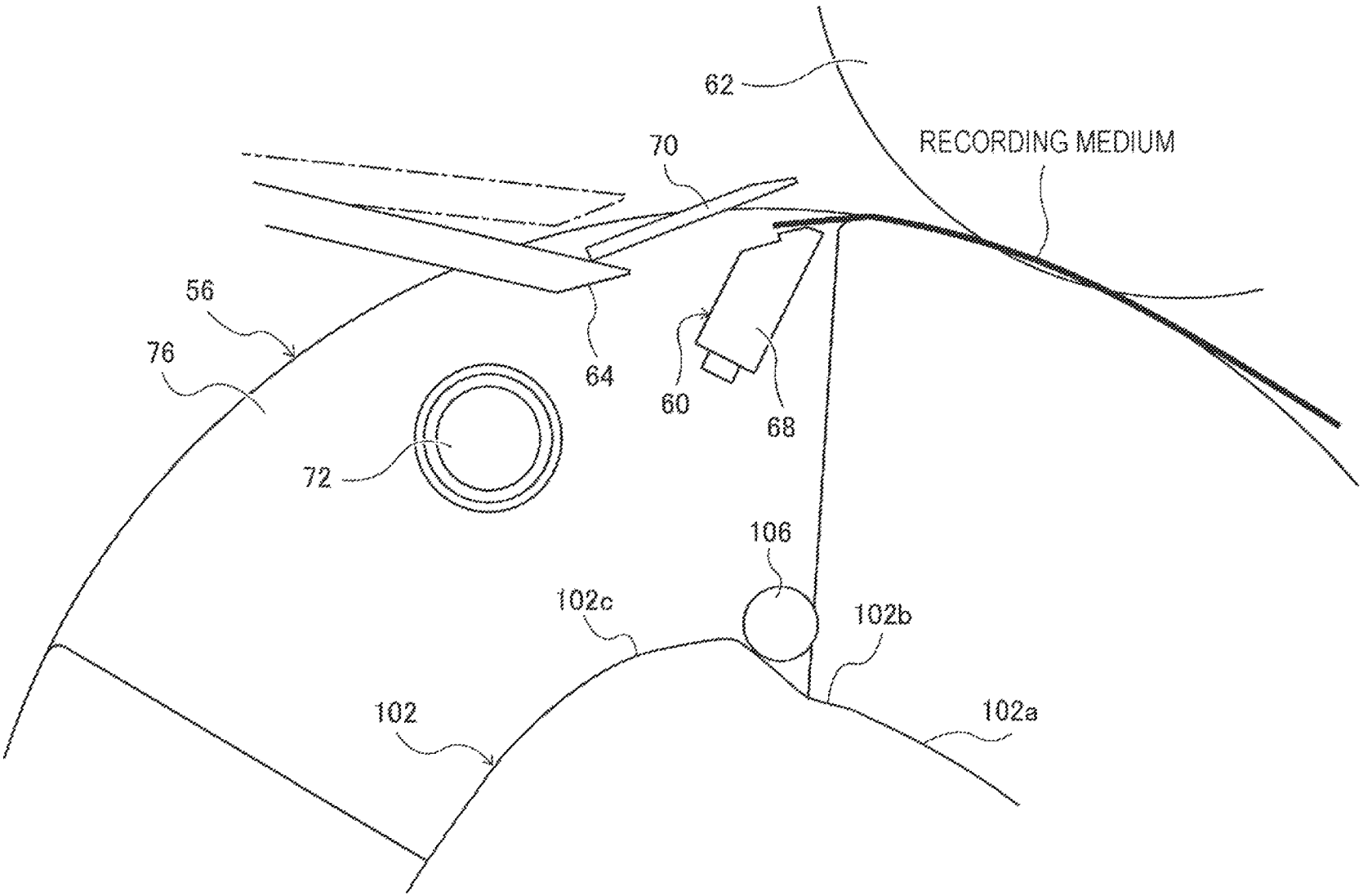
FIG. 12 is an enlarged front view of the fixing device showing a state before the movable jaws are widely opened in the image forming apparatus according to the exemplary embodiment of the present disclosure.

FIG. 12 shows a state before the movable jaws 70 are widely opened. Although the recording medium may bounce up because the leading end thereof is released, in this state, the tips of the movable jaws 70 are located within the moving range of the leading end of the recording medium, and thus, the movable jaws 70 prevent the recording medium from bouncing up.

Figure 13:
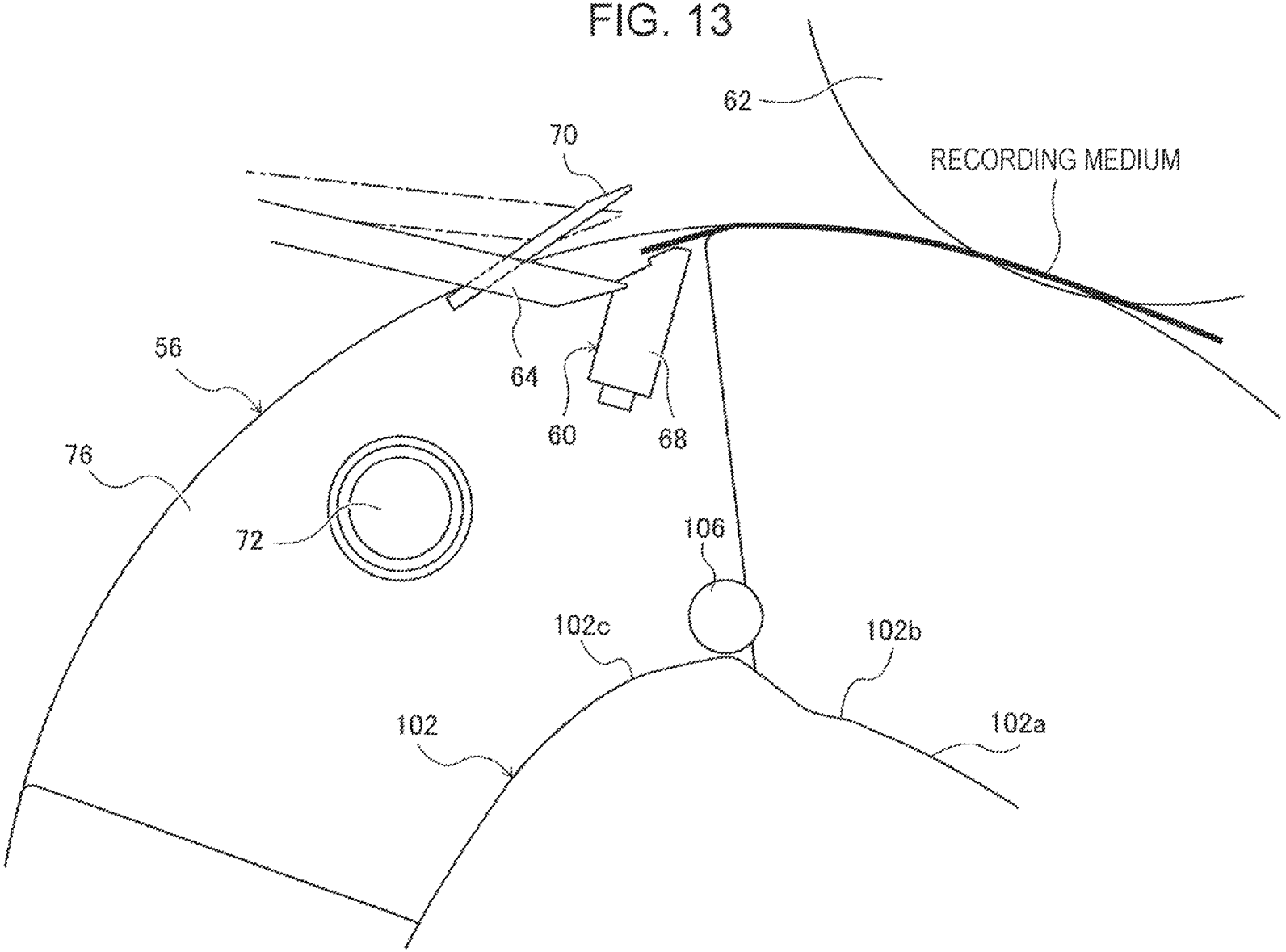
FIG. 13 is an enlarged front view of the fixing device showing a state in which the movable jaws are open to the maximum in the image forming apparatus according to the exemplary embodiment of the present disclosure.

FIG. 13 shows a state in which the movable jaws 70 are open to the maximum. The tip of the separating member 64, which is located inside the recess 76 in the fixing drum 56, approaches the leading end of the recording medium. Because the movable jaws 70 are open to the maximum, the tips of the movable jaws 70 are located outside the moving range of the leading end of the recording medium, and the separating member 64 prepares for lifting the leading end of the recording medium.

Figure 14:
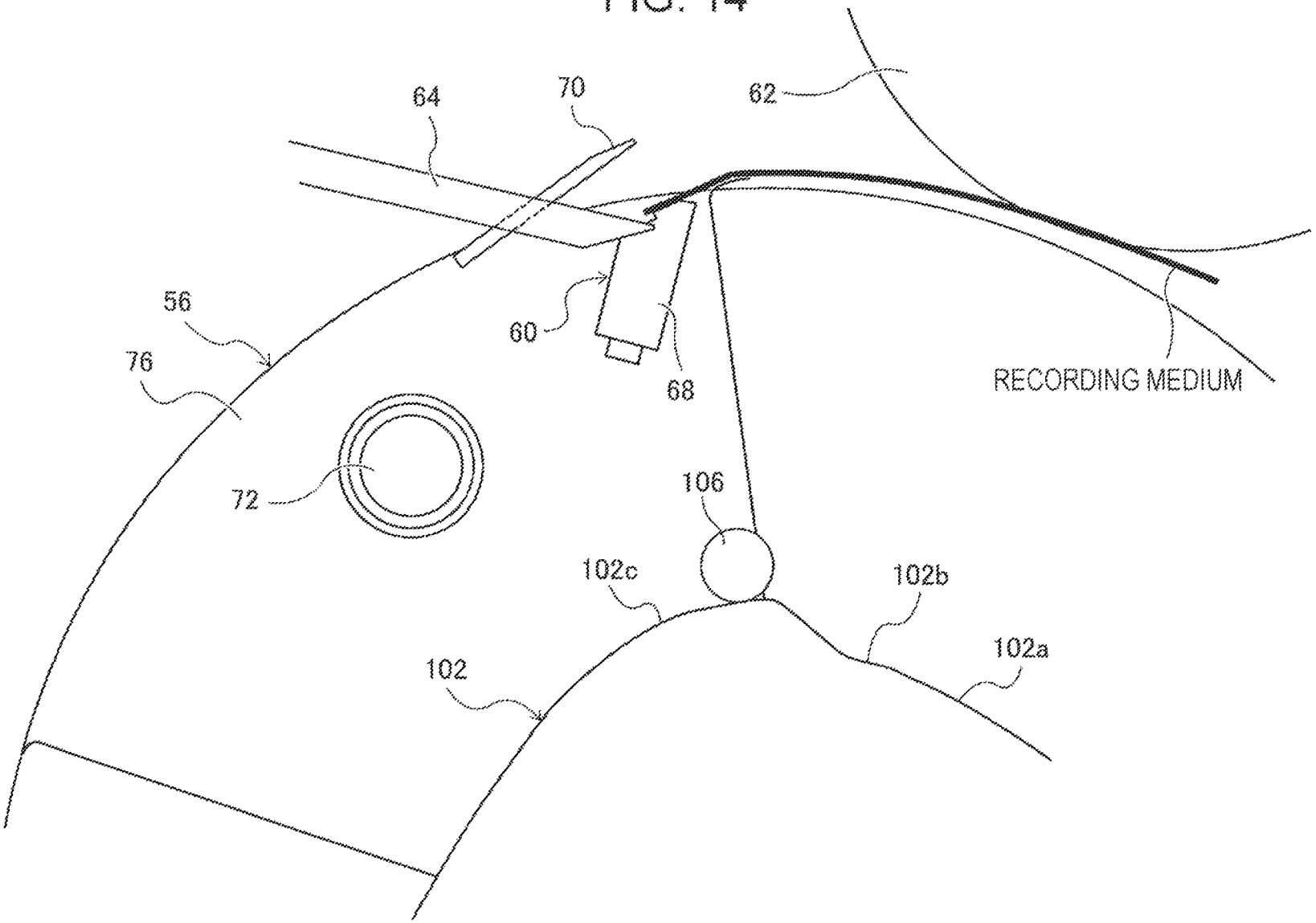
FIG. 14 is an enlarged front view of the fixing device showing a state in which the separating member starts to move upward in the image forming apparatus according to the exemplary embodiment of the present disclosure.
Figure 15:
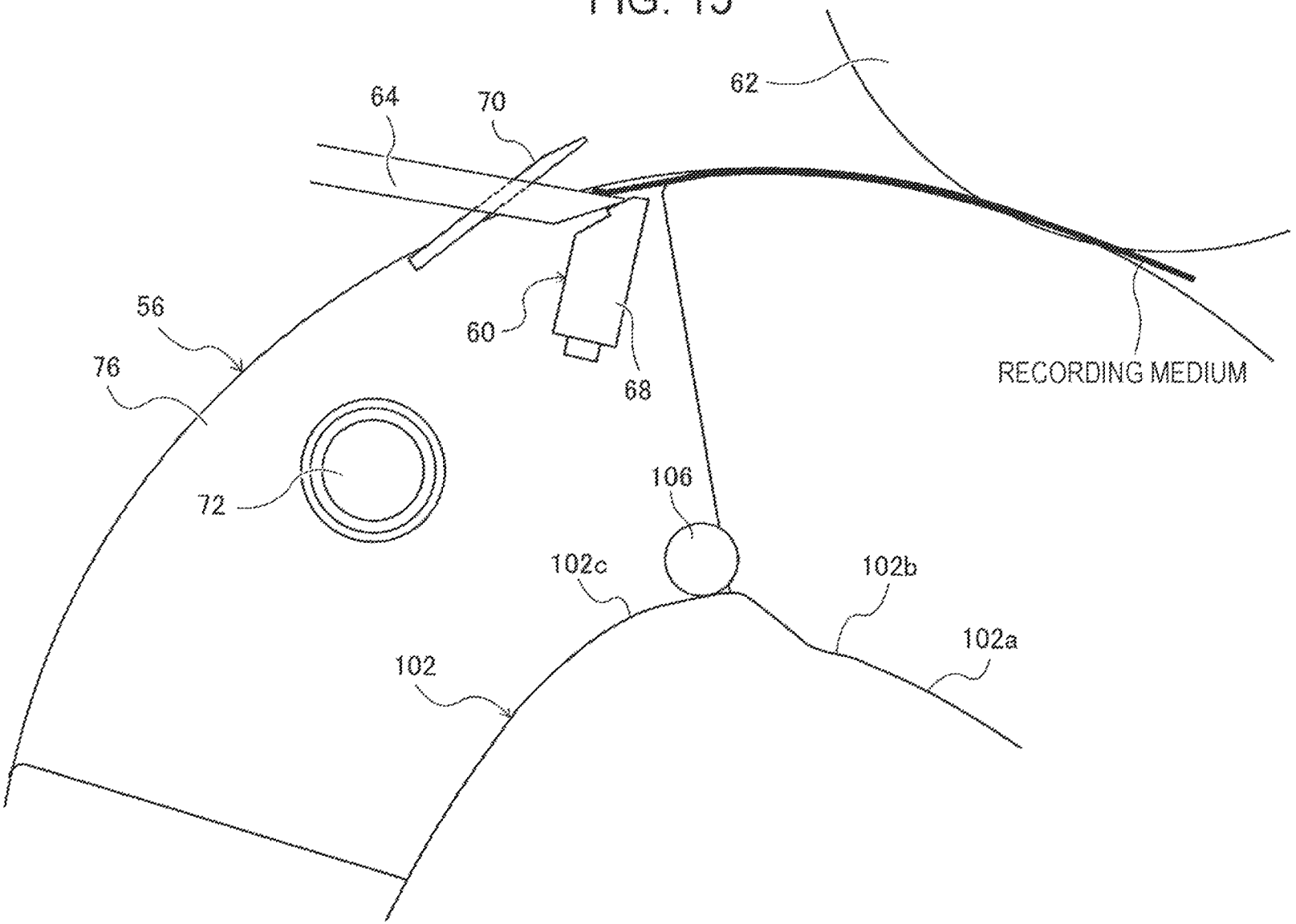
FIG. 15 is an enlarged front view of the fixing device showing a state in which the separating member is positioned below the leading end of the recording medium in the image forming apparatus according to the exemplary embodiment of the present disclosure.
Figure 16:
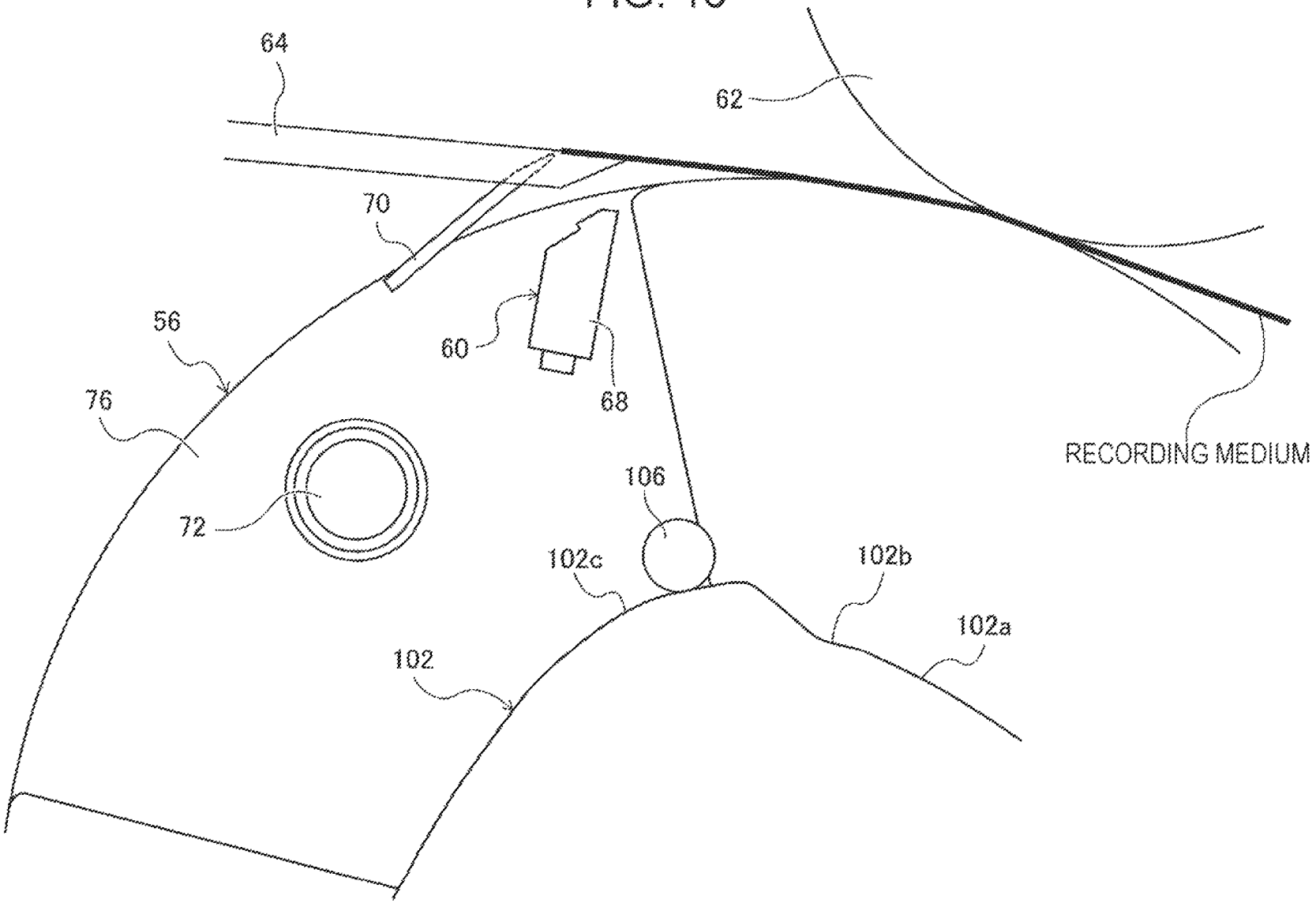
FIG. 16 is an enlarged front view of the fixing device showing a state in which the separating member lifts the leading end of the recording medium in the image forming apparatus according to the exemplary embodiment of the present disclosure.

Referring back to FIG. 8, at angle f, at which the movable jaws 70 are open to the maximum, the separating member 64 starts to move upward. When the separating member 64 starts to move upward, as shown in FIG. 14, the tip of the separating member 64 approaches the leading end of the recording medium while moving upward. When the fixing drum 56 rotates further, as shown in FIG. 15, the tip of the separating member 64 enters below the leading end of the recording medium. Then, as shown in FIG. 16, the tip of the separating member 64 moves outward of the outer circumference of the fixing drum 56, thus lifting the leading end of the recording medium, and the recording medium is guided to the top surface of the separating member 64.

In the above-described exemplary embodiment, the contact and separation between the heating member 62 and the fixing drum 56, the opening and closing of the movable jaws 70, and the movement of the separating member 64 are controlled by using the cam rotating about the fixing-drum rotary shaft 74 or cam followers. However, the structure of the present disclosure is not limited thereto, and these operations may be controlled by other members that rotate in synchronization with the fixing drum 56. Furthermore, the present disclosure may employ a structure in which these operations are electrically controlled by using a motor or the like, besides a structure using the cam mechanisms, as in the above-described exemplary embodiment.

Furthermore, the configuration of the image forming apparatus is not limited to the configuration as described in the above-described exemplary embodiment, and, for example, the image forming apparatus may be an ink jet recording apparatus, and various configurations are possible. The present disclosure may be implemented in various forms within a scope not departing from the spirit thereof.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A recording-medium transport device comprising:

a first member that rotates;

a second member that rotates, the first member and the second member forming a nip area therebetween and transporting a recording medium while nipping;

a gripping member that grips the recording medium;

a separating member that separates the recording medium having passed through the nip area from the first member or the second member; and a control mechanism that controls contact and separation between the first member and the second member and opening and closing of the gripping member such that, in a first section in which the gripping member passes between the first member and the second member, the first member and the second member are separated, and the gripping member is opened so as to release the recording medium until the first member and the second member are brought into contact with each other next time, and, in a second section subsequent to the first section and before the recording medium reaches the separating member, the gripping member is opened wider than in the first section.

2. The recording-medium transport device according to claim 1, wherein the gripping member includes a fixed jaw and a movable jaw, which moves into contact with and away from the fixed jaw, and is opened such that the movable jaw does not touch the first member or the second member.

3. The recording-medium transport device according to claim 1, wherein the gripping member includes a fixed jaw and a movable jaw, which moves into contact with and away from the fixed jaw, and, in the first section, is opened within a separation area between the first member and the second member.

4. The recording-medium transport device according to claim 1, wherein the gripping member includes a fixed jaw and a movable jaw, which moves into contact with and away from the fixed jaw, and, in the second section, is opened such that the recording medium does not touch the movable jaw when the recording medium is separated.

5. The recording-medium transport device according to claim 1, wherein the gripping member includes a fixed jaw and a movable jaw, which moves into contact with and away from the fixed jaw, and, in the second section, is opened wider than a moving area of the recording medium when the recording medium is separated.

6. The recording-medium transport device according to claim 1, wherein the separating member moves in a direction in which the recording medium is separated from the first member or the second member.

7. The recording-medium transport device according to claim 2, wherein the separating member moves in a direction in which the recording medium is separated from the first member or the second member.

8. The recording-medium transport device according to claim 3, wherein the separating member moves in a direction in which the recording medium is separated from the first member or the second member.

9. The recording-medium transport device according to claim 4, wherein the separating member moves in a direction in which the recording medium is separated from the first member or the second member.

10. The recording-medium transport device according to claim 5, wherein the separating member moves in a direction in which the recording medium is separated from the first member or the second member.

11. The recording-medium transport device according to claim 6, wherein the control mechanism also controls the movement of the separating member.

12. The recording-medium transport device according to claim 7, wherein the control mechanism also controls the movement of the separating member.

13. The recording-medium transport device according to claim 8, wherein the control mechanism also controls the movement of the separating member.

14. The recording-medium transport device according to claim 9, wherein the control mechanism also controls the movement of the separating member.

15. The recording-medium transport device according to claim 10, wherein the control mechanism also controls the movement of the separating member.

16. A fixing device comprising:

a heating member that rotates;

a fixing drum that rotates, the heating member and the fixing drum forming a nip area therebetween and applying a recording-medium pressure to a recording medium while nipping;

a gripping member that grips the recording medium;

a separating member that separates the recording medium having passed through the nip area from the fixing drum; and a control mechanism that controls contact and separation between the heating member and the fixing drum and opening and closing of the gripping member such that, in a first section in which the gripping member passes between the heating member and the fixing drum, the heating member and the fixing drum are separated, and the gripping member is opened so as to release the recording medium until the heating member and the fixing drum are brought into contact with each other next time, and, in a second section subsequent to the first section and before the recording medium reaches the separating member, the gripping member is opened wider than in the first section.

17. The fixing device according to claim 16, wherein the control mechanism includes a cam mechanism that is operated by rotation of the fixing drum.

18. An image forming apparatus comprising:

an image forming unit that forms a developer image on a recording medium; and a fixing device that fixes the developer image formed on the recording medium by the image forming unit onto the recording medium, wherein the fixing device includes:

a heating member that rotates;

a fixing drum that rotates, the heating member and the fixing drum forming a nip area therebetween and applying a recording-medium pressure to a recording medium while nipping;

a gripping member that grips the recording medium;

a separating member that separates the recording medium having passed through the nip area from the fixing drum; and a control mechanism that controls contact and separation between the heating member and the fixing drum and opening and closing of the gripping member such that, in a first section in which the gripping member passes between the heating member and the fixing drum, the heating member and the fixing drum are separated, and the gripping member is opened so as to release the recording medium until the heating member and the fixing drum are brought into contact with each other next time, and, in a second section subsequent to the first section and before the recording medium reaches the separating member, the gripping member is opened wider than in the first section.

* * * * *